US006230639B1

(12) United States Patent
McLaughlin et al.

(10) Patent No.: US 6,230,639 B1
(45) Date of Patent: May 15, 2001

(54) SINGLE MOTOR BOAT LIFT HAVING HORIZONTALLY AND LONGITUDINALLY DRIVEN CABLES

(75) Inventors: Shawn M. McLaughlin, Punta Gorda; Daniel S. Carter, Fort Myers; Charles L. Sargent, Bonita Springs; John Kohlhauff, Estero, all of FL (US)

(73) Assignee: Quality Boat Lifts, Inc., Fort Myers, FL (US)

( * ) Notice: Subject to any disclaimer, the term of this patent is extended or adjusted under 35 U.S.C. 154(b) by 0 days.

(21) Appl. No.: 09/585,116

(22) Filed: Jun. 1, 2000

Related U.S. Application Data

(60) Provisional application No. 60/136,956, filed on Jun. 1, 1999.

(51) Int. Cl.[7] ..... B63C 1/02

(52) U.S. Cl. ..... 114/44; 405/3

(58) Field of Search ..... 114/44, 45, 48, 114/51; 405/3, 4

(56) References Cited

U.S. PATENT DOCUMENTS 3,265,024 * 8/1966 Kramlich ..... 114/45
4,686,920 * 8/1987 Thomas ..... 114/48

* cited by examiner

*Primary Examiner*—Ed Swinehart
(74) *Attorney, Agent, or Firm*—William E. Noonan

(57) ABSTRACT

A single motor, multiple cable boat lift is employed. The lift includes a platform and a pair of pilings disposed on each of the opposing sides of the platform. A first pair of cables innerconnect one side of the platform with the first pair of pilings and second pair of cables innerconnect the opposite side of the platform with the second pair of pilings. There is a single motor and a cable transmission apparatus that operably innerconnects the motor and all cables such that operation of the motor selectively retracts and extends the cables in a synchronized manner to raise and lower the lift platform.

12 Claims, 5 Drawing Sheets

SINGLE MOTOR BOAT LIFT HAVING HORIZONTALLY AND LONGITUDINALLY DRIVEN CABLES

RELATED APPLICATION

This application claims the benefit of U.S. Provisional patent application Ser. No. 60/136,956 filed Jun. 1, 1999.

FIELD OF THE INVENTION

This invention relates to a boat lift having a single drive motor and a plurality of synchronized lifting cables. At least a pair of cables are driven horizontally and longitudinally relative to the boat being lifted or lowered. The boat lift is mounted to multiple pilings or support posts arranged on opposing longitudinal sides of the boat.

BACKGROUND OF THE INVENTION

The boat lifts currently designed for use with medium and larger size vessels exhibit a number of shortcomings. Normally, such lifts feature a respective motor, winder and independently driven cable system mounted to support posts or pilings on each longitudinal side of the boat. As a result, these mechanisms tend to be quite expensive and complicated. Installation is usually time consuming and labor intensive. Utilizing multiple motors is particularly costly and inefficient. Moreover, it is often quite difficult to accurately synchronize the operation of the motors. The respective sides of the lift platform which supports the vessel are apt to be raised or lowered at different rates. The platform is thereby likely to tilt during operation.

At least one known four piling boat lift has eliminated independently operated cables and associated cable beams from respective longitudinal sides of the lift. Instead, that device employs a pair of motors and corresponding pulley assemblies mounted at the front and back ends of the boat lift. This apparatus continues to require a pair of motors, which are quite costly and inefficient. It also exhibits synchronization problems because of the use of multiple independent motors.

Most conventional multiple cable/multiple piling boat lifts experience problems associated with speed reduction and cable wear. The output of each motor must be reduced to provide an appropriate speed and torque for raising and lowering the lift. Today, this almost always necessitates the use of a fairly complex reduction system. Standard cable winders or drums also tend to cause difficulties. Most known winders have a relatively small diameter, which tends to over-stress the cable as it is being wound onto or off of the winder. This can shorten the life of the cables, thereby requiring the lift owner to change cables more often. Such repairs are costly and render the lift inoperable while they are being performed.

SUMMARY OF THE INVENTION

It is therefore an object of this invention to provide a boat lift that utilizes only a single motor to operate multiple lifting cables or wires on both longitudinal sides of the lift.

It is a further object of this invention to provide a single motor boat lift which greatly reduces the expense and complexity normally associated with multiple cable/multiple piling boat lifts.

It is a further object of this invention to provide a boat lift that automatically and accurately synchronizes raising and lowering of the cables or wires on both longitudinal sides of the boat lift so that an improved, stable and level lifting and lowering operation is achieved.

It is a further object of this invention to provide a three or four piling boat lift that employs only a single cable beam on one side of the lift and which therefore eliminates considerable expense and complexity from such lifts.

It is a further object of this invention to provide a single motor, multiple cable boat lift that operates much more reliably and efficiently than known boat lifts.

It is a further object of this invention to provide a boat lift that exhibits simplified drive reduction and reduced cable failure.

It is a further object of this invention to provide a single motor, multiple cable boat lift that may be installed and repaired relatively quickly and conveniently.

It is a further object of this invention to provide a boat lift that may be used effectively with various combinations of single and multiple part lifting cables.

This invention features a single motor, multiple cable boat lift including a lift platform that extends generally between a proximal support structure on one longitudinal side of the boat to be lifted and a distal support structure located on the opposite longitudinal side of the boat. There is a single drive motor mounted to the proximal support structure. As used herein "proximal" is intended to refer to the structure on which the single drive motor and its related transmission components are supported. The motor is selectively driven in opposing first and second directions. The boat accommodating platform includes proximal and distal sides located relatively adjacent to the proximal and distal support structures, respectively. There are first cable means including at least a pair of cables operably connected to the proximal side of the platform for enabling raising and lowering thereof. There are also second cable means including at least a pair of cables operably connected to the distal side of the platform for enabling raising and lowering thereof. At least one cable in each of the first and second cable means is operably mountable to the proximal support structure such that operating the motor causes a portion of the cable to be driven generally horizontally and longitudinally relative to the boat. Cable transmission means operably interconnect each of the cable means with the single motor for retracting the cables when the motor is driven in a first direction to synchronously raise the proximal and distal sides of the platform. The cable transmission means advance the cables when the motor is driven in the second direction to synchronously lower the proximal and distal sides of the platform. As a result, the watercraft mounted on the platform is selectively raised and lowered relative to the water.

In a preferred embodiment, the proximal support structure includes a plurality of spaced apart pilings or support posts disposed on one longitudinal side of the watercraft and the distal support structure includes a second pair of pilings or support posts disposed on the opposite side of the watercraft. The single drive motor and the cable transmission means are preferably mounted to the proximal support structure. That support structure may also specifically comprise a longitudinal cable beam that horizontally interconnects the pilings in the proximal support structure. The motor and cable transmission means may be attached to and generally depend from the longitudinal cable beam between the support post or pilings. Alternatively, the motor and/or cable transmission means may be mounted directly to one or more of the support posts.

Means may be provided for operably mounting at least one cable of each cable means to the proximal support structure such that the cable is movable longitudinally and horizontally relative to the boat. Preferably, both the proximal and distal cable means are mounted in this manner such that each cable in the lift is movable in a generally horizontal and longitudinal fashion. The means for operably mounting the cable means may include directional pulleys that are rotatably mounted in the longitudinal beam.

The proximal cable means may include a pair of single part (e.g. one vertical drop) cables. The distal cable means may include a pair of multiple part (e.g. three part) cables. Each single part cable may engage a pair of directional pulleys in the cable beam, which pulleys direct the single part cable upwardly from the transmission means, longitudinally through the cable beam and vertically downwardly to fasten to the proximal side of the lift platform. More particularly, the lift platform may include a pair of spaced apart cradle beams that are extendable transversely beneath the boat. The lower end of each single part cable may be attached to a proximal end of a respective cradle beam. The lift platform may include a parallel pair of transversely extending cradle beams. Each single part cable is typically attached by a releasable locking apparatus to a respective one of the cable beams adjacent the proximal support structure.

Each multiple part cable may interengage a respective set of multiple directional pulleys. For example, in a three part cable system, two pulleys may be mounted in the cable beam, two may be mounted at respective opposite ends of each cradle beam and one may be supported at the upper end of a respective one of the support pilings of the distal support structure. The pulleys direct an associated three part cable from the cable beam downwardly to a respective cradle beam, along that cradle beam and upwardly along a respective one of the distal pair of pilings. Finally, the three part cable is directed downwardly along that distal piling and releasably secured to the distal end portion of its associated cradle beam.

The preferred embodiments shown herein describe a pair of one part and pair of three part lift cables, although in alternative versions, other types of multiple part cables may be utilized for raising and lowering the lift platform. Different numbers of cables and other combinations of cables may be used on each side of the vessel.

The cable transmission means may include a winder assembly comprising a plurality of coaxial, fixedly joined winder drums. A preferred winder assembly used in connection with the four cable version of this invention employs a pair of multiple (three) part winder drums having relatively large diameters and a pair of one part winder drums having relatively smaller diameters. The diameters are selected so that the proximal and distal cables means synchronously raise and lower the proximal and distal sides, respectively, of the platform. Means may be employed for operably interconnecting the output of the single motor with the winder assembly. The means for operably interconnecting the output of the motor and the winder assembly may include appropriate reduction means such as chains and sprockets or belts and pulleys.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
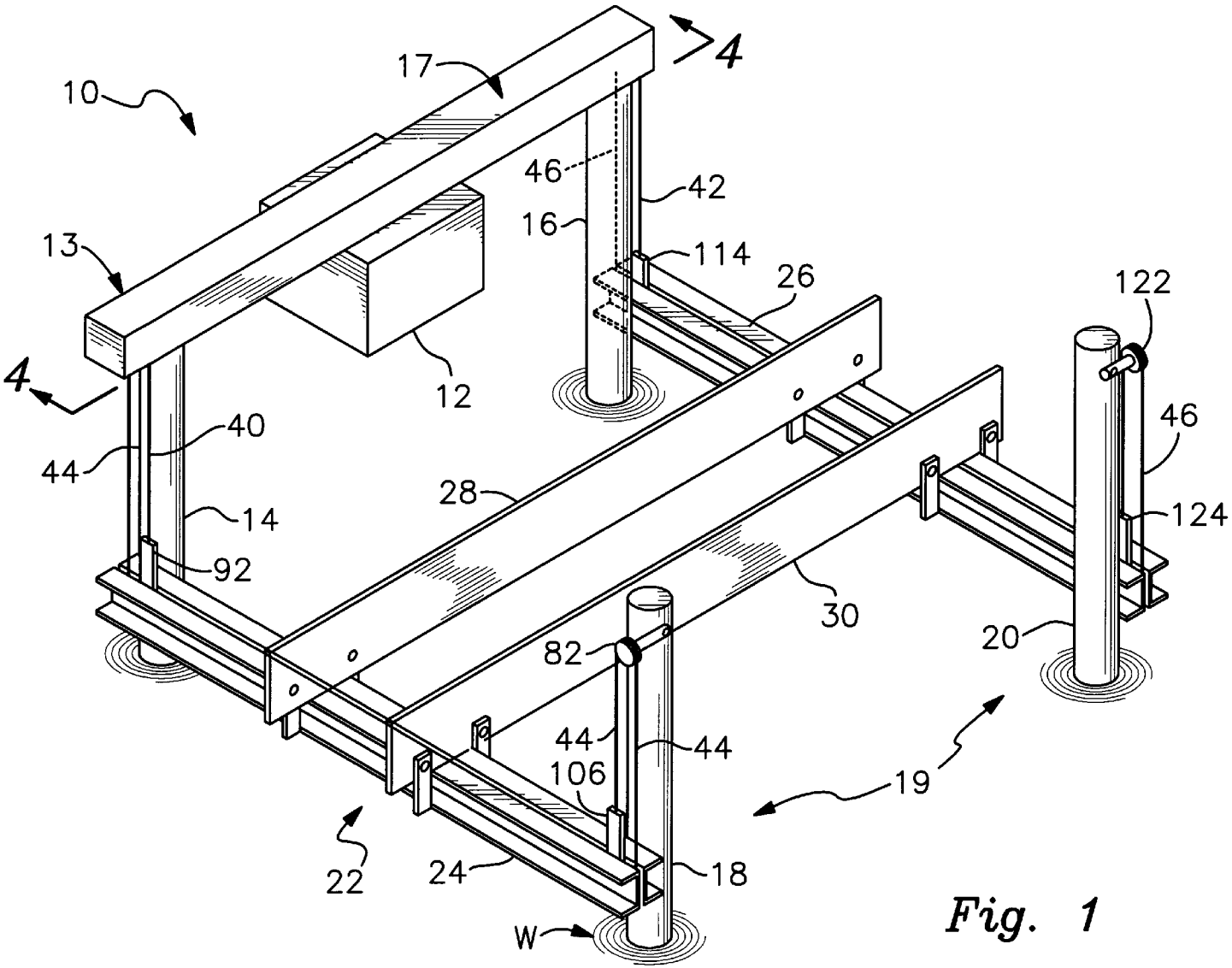
FIG. 1 is a perspective view of a preferred boat lift apparatus in accordance with this invention.
Figure 2:
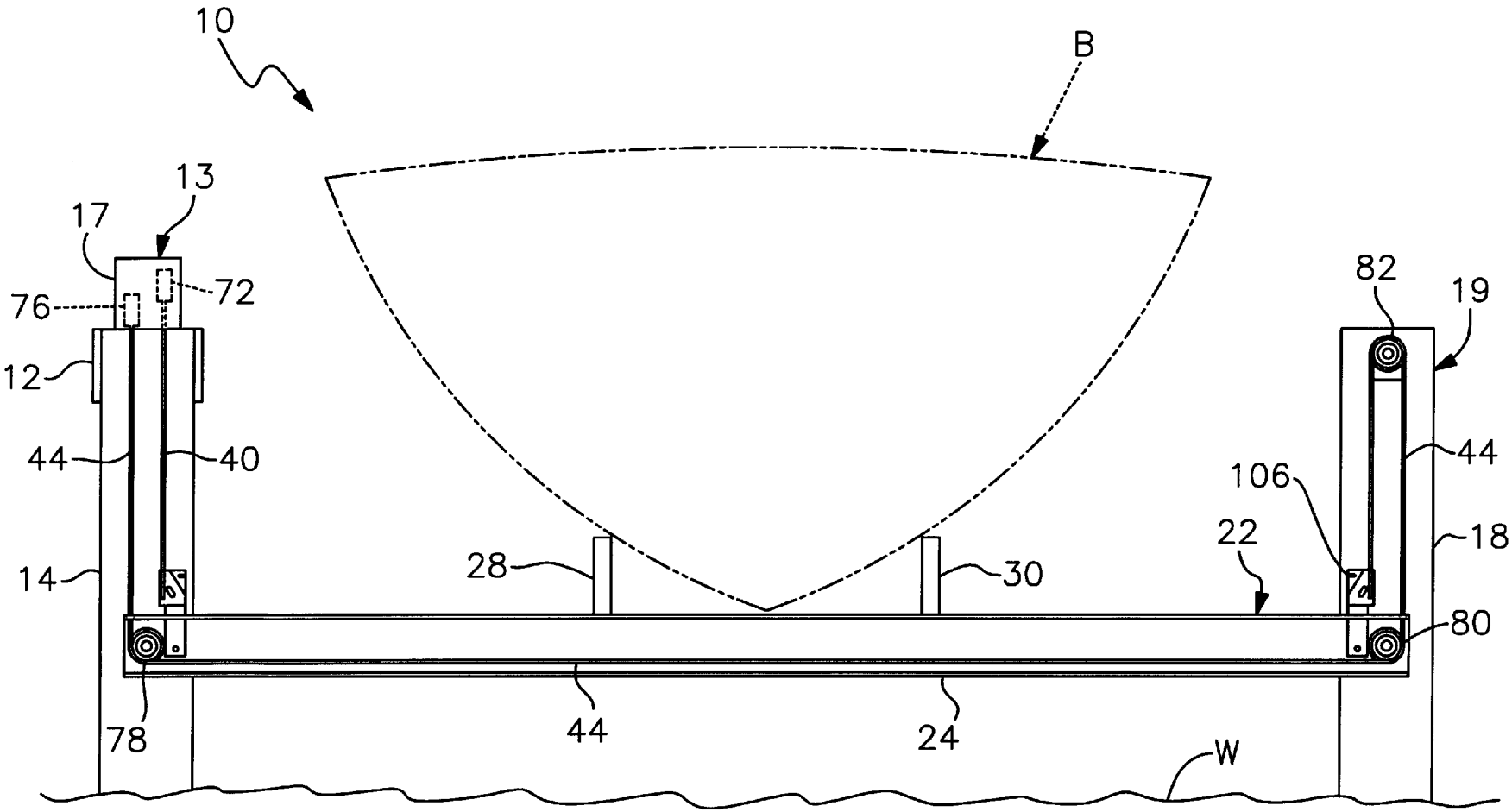
FIG. 2 is an elevational end view of the lift apparatus with the depicted cradle beam shown in cross section to illustrate the structure for engaging the lift cables with that beam.
Figure 3:
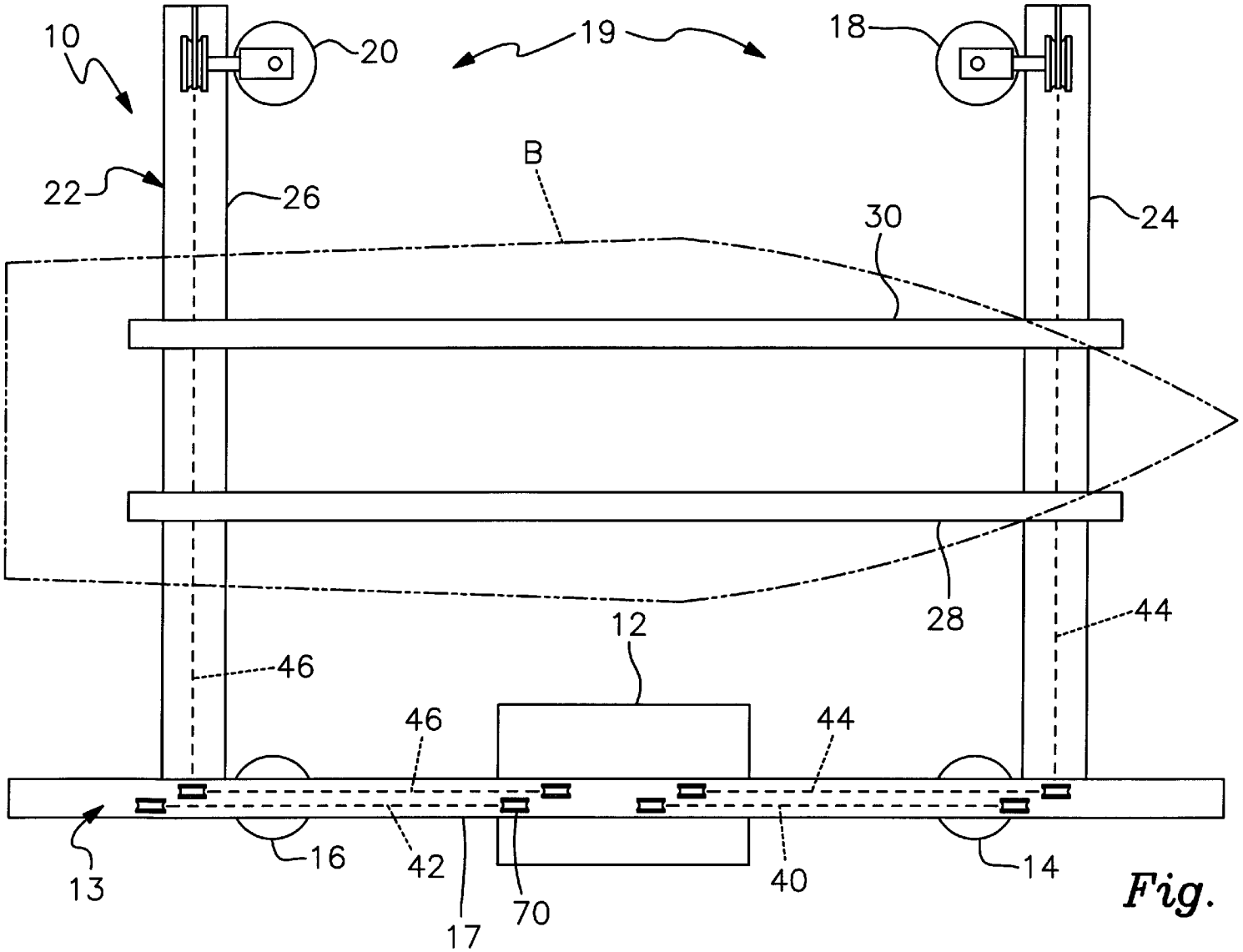
FIG. 3 is a top plan view of the lift apparatus.

There is shown in FIGS. 1 through 3 a boat lift apparatus 10 comprising a single motor drive 12. Lift 10 is employed to selectively raise and lower a boat B, shown in phantom in FIGS. 2 and 3, out of and into a body of water. It should be understood that the lift can be utilized for virtually all types of boats and other watercraft. The lift may be located proximate a dock, pier, seawall, or other structure bordering a boat slip or storage space. The apparatus is suitable for use in virtually any body of water in which a boat lift is normally employed.

Lift 10 includes a proximal support structure 13, FIGS. 1–4, comprising a longitudinally spaced apart pair of pilings or support posts 14 and 16, which are typically arranged beside the dock, pier or sea wall. These pilings are likewise positioned adjacent the body of water in which the vessel is stored, and more particularly adjacent to one longitudinal side (i.e. the proximal side) of that vessel. The pilings may be composed of wood or a synthetic material. Proximal support structure 13 also includes an elongate cable beam 17 that extends between and is secured to pilings 14 and 16. In the embodiment that is disclosed, beam 17 is secured to the tops of pilings 14 and 16. In alternative embodiments the cable beam may be interconnected by various forms of attachment to the sides of the pilings. Beam 17 is preferably composed of aluminum or an alternative non-corrosive material. The cable beam may comprise an elongate piece of rectangular or otherwise hollow tubing, although other configurations may be utilized. The drive mechanism of lift is supported by beam 17. Mechanism 12 is described more fully below.

As best shown in FIGS. 1–3, a second, distal support structure 19 is formed on the opposite longitudinal side of boat B. In this version, support structure 19 includes a longitudinally spaced apart pair of distal pilings 18 and 20 that generally oppose pilings 14 and 16, respectively. Each of the pilings 14, 16, 18 and 20 is mounted within (or alternatively proximate to) the body of water W in which the vessel is stored and each piling extends upwardly from the water in a conventional manner. As best shown in FIGS. 2 and 3, when boat B is positioned on lift 10, the pilings 14, 16, 18 and 20 are arranged along respective longitudinal sides of the boat. In alternative embodiments, the pilings may be replaced by other types and numbers of support structures. In still other versions, a three piling lift may be featured, with two support pilings and an interconnected cable beam located on the proximal side of the vessel and a single piling disposed on the opposite, distal side.

Figure 5:
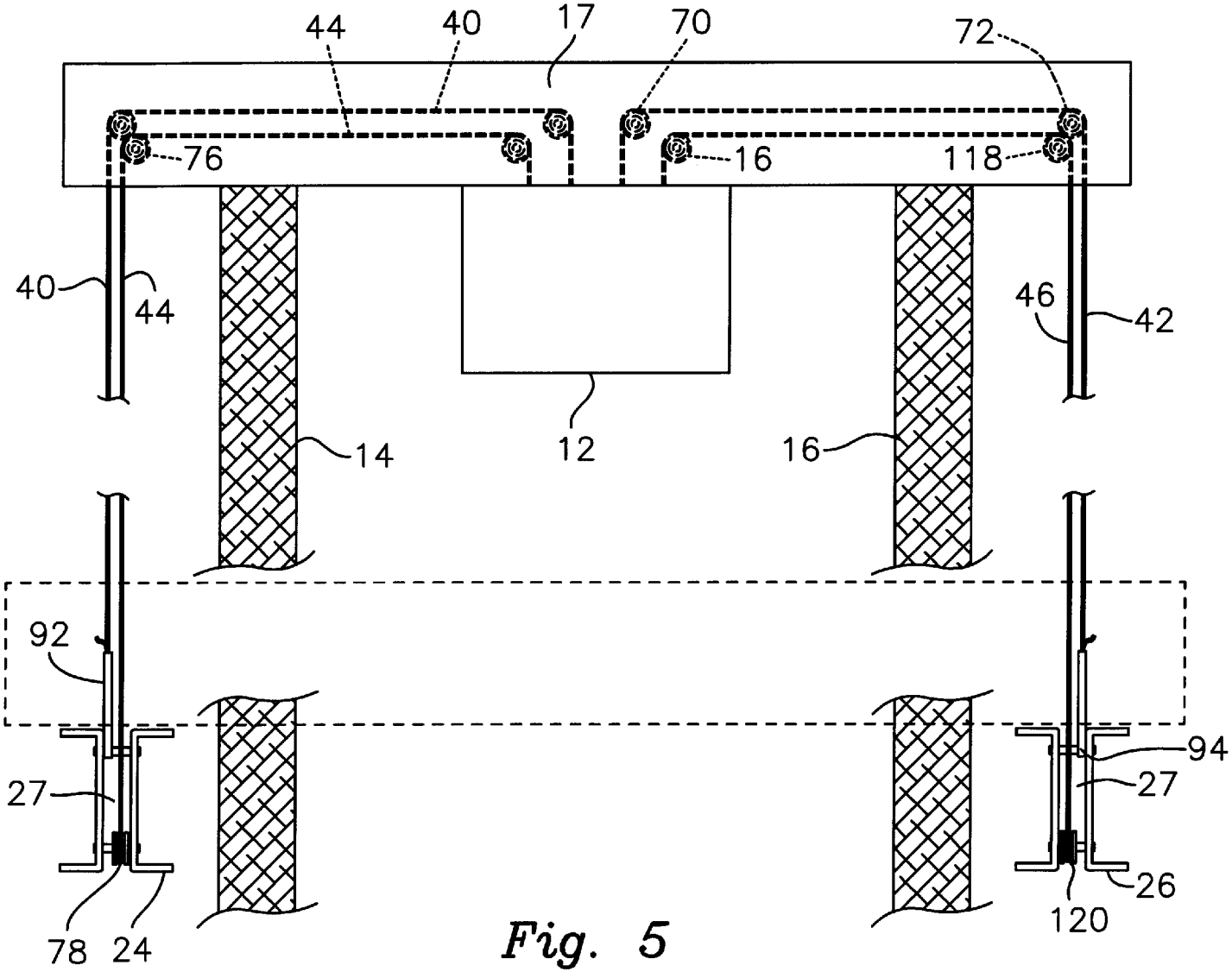
FIG. 5 is an elevational proximal side view of the lift apparatus.

A lift platform 22 is operably (i.e. vertically movably) mounted to the support pilings. Platform 22 comprises a pair of generally parallel cradle beams 24 and 26 that extend beneath boat B and are arranged transversely to the axis of the boat. As best shown in FIG. 5, each cradle beam may effectively comprise an I-beam employing a pair of abutting, generally C-shaped metal channels that are connected together by bolts, welding or other appropriate means. As is further described below, a gap 27 is disposed between the channels for receiving directional pulleys that are mounted to the cradle beams. It should be noted that gap 27 is somewhat exaggerated in FIG. 5 for clarity. It should also be understood that the cradle beams may comprise a wide variety of alternative constructions that permit the beams to carry directional pulleys and be operably interengaged with lifting cables.

Lift platform 22 also includes a parallel pair of bunk boards 28 and 30 that extend transversely across and are mounted to the upper surfaces of cradle beams 24 and 26. The bunk boards extend generally longitudinally relative to the accommodated boat B. Bunk boards 28 and 30 typically comprise wood or appropriate synthetic material. They are bolted or otherwise secured to the cradle beams in a known manner. When the boat is mounted on the lift, it sits on the bunk boards as best shown in FIGS. 2 and 3.

As previously described, elongate cable beam 17 is mounted to and extends between the upper ends of pilings 14 and 16. The beam comprises a durable metal or plastic material. It has a generally hollow construction that is able to accommodate the cables of the apparatus.

Lift 10 includes four cable assemblies. Referring to FIGS. 1–5, a pair of single part cables 40 and 42 are connected to the proximal ends of cradle beams 24 and 26, respectively, directly beneath longitudinal cable beam 17. A second pair of multiple part cables 44 and 46 are connected respectively to the outer or distal ends of cradle beams 24 and 26. These four cables are driven longitudinally by the single motor drive 12 of this invention to raise and lower lift platform 22. As used herein, "cables" may comprise multiple or single strand wire or rope, as well as various other types of strong, durable, flexible and preferably corrosion resistant components suited for use in boat lifts.

Figure 4:
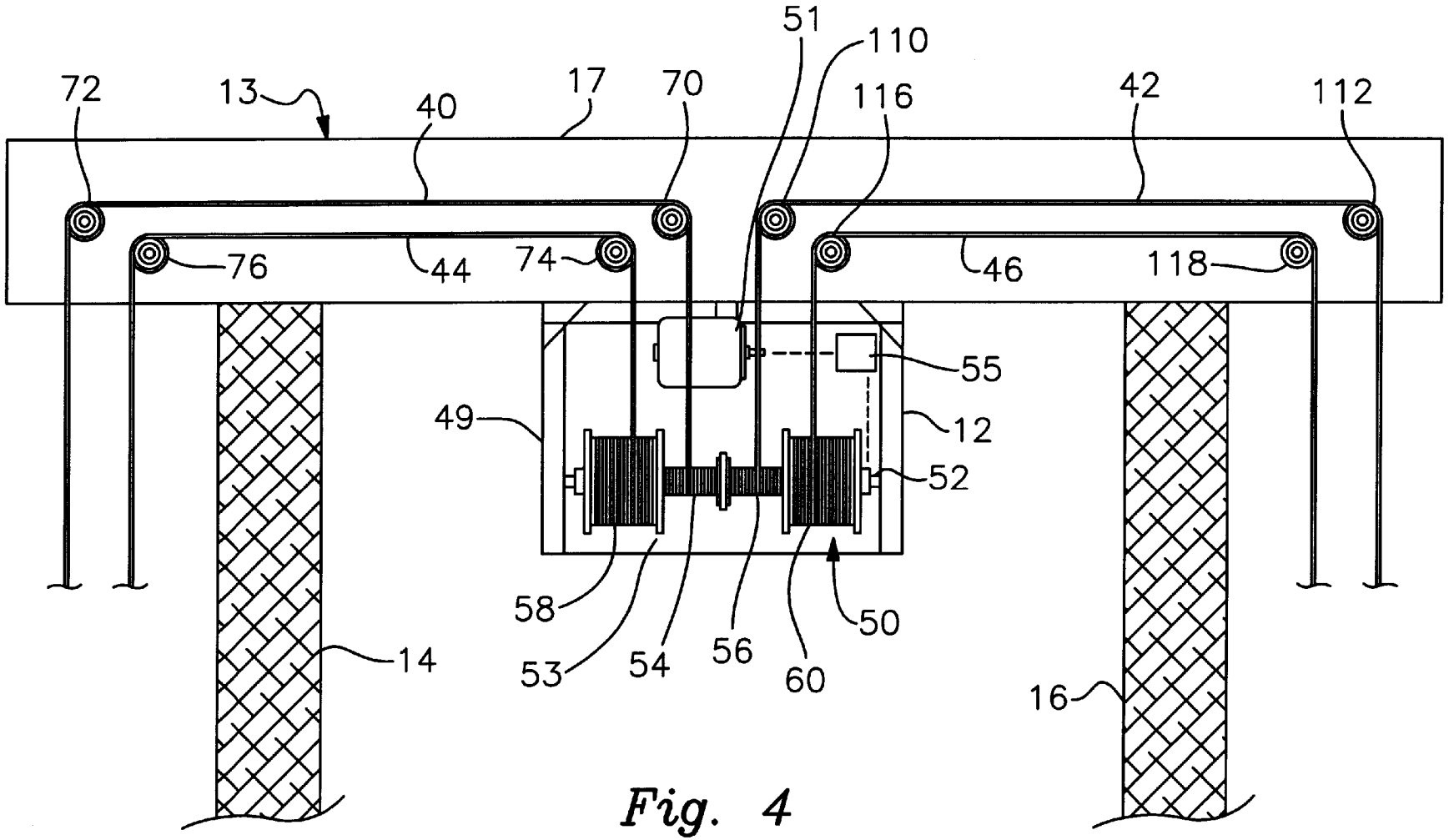
FIG. 4 is an cross sectional, partly schematic view taken along line 4—4 of FIG. 1, of the upper end of the proximal support structure; the cable beam and drive motor housing are cut away to illustrate a preferred cable arrangement.

As shown in FIG. 4, drive 12 includes an exterior enclosure or housing 15 that is attached to and internally communicates with beam 17. A single motor 51, which may comprise various types and sizes of motors suitable for use in the boat lift industry, is supported within housing 15 by brackets, bolts or other standard means. The motor should be operable in opposing first and section directions for respectively raising and lowering the boat accommodating platform.

The first or upper end of each cable is operably connected to cable transmission means 50, which may comprise a winder assembly, FIGS. 4 and 5. The winder assembly is supported along with single motor 51 within an enclosure or housing 15 carried by longitudinal cable beam 17. Housing 15 may be secured to cable beam 17 by various means of attachment.

The motor is operably connected by cable transmission means 50 to each of the lift cables 40, 42, 44 and 46. In the version disclosed in FIG. 4, cable transmission means 50 include a coaxial four drum winder assembly 53. The winder assembly is operably connected to and rotatably driven by motor 51 by appropriate known forms of reduction means 55 such as sprockets and chains, belts and pulleys, gears or otherwise. Assembly 53 features an axially rotatable shaft 52 that is mounted within appropriate bearing in housing 49. Four winder segments or drums 54, 56, 58 and 60 are fixedly joined along shaft 52 such that the drums rotate in unison with the shaft. In alternative embodiments the drums may rotate about a fixed shaft or the shaft may be eliminated and the interconnected drums may be rotatably supported by appropriate bearings. The drums may also be disengaged from one another and independently rotatable by respective reduction means. Such means may again comprise chains and sprocket, belts and pulley and/or gear which appropriately reduce the speed of the motor to the speed required for each winder drum. Small diameter drums 54 and 56 are single part winder segments. Single part cables 40 and 42 are connected to and wound upon drums 54 and 56, respectively, in a known manner. Likewise, multiple part cables 44 and 46 are respectively connected to and wound upon large diameter drums 58 and 60.

In operation, motor 51 rotates in a first direction to drive the winder drums, 54, 56, 58 and 60 in a direction that winds the respective cables 40, 42, 44 and 46 onto the respective drums. Alternatively, motor 51 may be driven in the opposite direction so that the winder segments rotate to deploy the cables from the respective drums. This operation is described more fully below.

As shown in FIGS. 1–5, the respective cables extend from housing 49 of drive 12, through cable beam 17 and to their intended destinations on lift platform 22. More particularly, each cable operably (e.g. longitudinally movably) engages and is directed by one or more directional pulleys to a point of attachment with the platform.

As best depicted by FIGS. 3–5, single part cable 40 extends upwardly from winder segment 54 and through the open bottom of beam 17. A directional pulley 70, which is mounted on an appropriate shaft or spindle within beam 17, directs cable 40 to extend generally longitudinally and horizontally through the cable beam. It should be noted that pulley 70 and the other directional pulleys mounted within cable beam 17 are rotatably and operably supported within the beam by means of appropriate bearings, mounts and brackets. A second directional pulley 72 redirects cable 40 vertically downward. As best shown in FIG. 5 and also in FIG. 1, the lower end of the cable is releasably secured to a cable lock apparatus 92 of the type disclosed in U.S. Pat. No. 5,988,941. The cable lock apparatus includes a depending mounting bracket 94, FIG. 5 that is interconnected between the abutting C-channels of cradle beam 24. When cable 40 is raised and lowered, this correspondingly raises and lowers the proximal end of cradle beam 24. That operation is described more fully below.

The opposite, distal end of cradle beam 24 is secured to multiple part (i.e. three part) cable 44. As shown in FIGS. 4 and 5, cable 44 extends from large diameter winder drum 58 and is directed vertically outwardly from drive housing 49 and into cable beam 17. A directional pulley 74 directs cable 44 longitudinally and generally horizontally through beam 17. A second pulley 76 redirects the cable vertically downwardly such that the cable drops below the cable beam. As shown in FIG. 5, cable 44 drops to cradle beam 24 where the cable operably engages a directional pulley 78 that is mounted in the gap 27 between the C-channels of that cradle beam. Once again, this gap is exaggerated for clarity. Pulley 78 may also be mounted to the cradle beam in a number of other ways. Pulley 78 directs multiple part cable 44 longitudinally through the cradle beam 24, as best shown in FIG. 2. The multiple part cable 44 is directed to the distal or outer end of cradle beam 24 (e.g. the end adjacent piling 18). There, cable 44 operably engages still another directional pulley 80 mounted between the abutting channels. As shown in FIGS. 1 and 2, this directs cable 44 vertically upwardly and generally along outer piling 18. The cable next engages a fifth directional pulley 82 mounted proximate the upper end of piling 18. This again causes cable 44 to reverse direction. The cable extends vertically downwardly generally along piling 18 and is secured by a releasable cable lock 106 attached to beam 24 in a manner analogous to that previously described for lock 92. Cable 44 and its associated directional pulleys 74, 76, 78, 80 and 82 thus form an operational three part cable assembly. When cable 44 is retracted (in the manner that will described below) this causes the distal end of cradle beam 24 to be raised. Alternatively, when cable 44 is extended from its winder drum 58, the distal end of cradle beam 24 is lowered.

The second single part cable 42 and second multiple part cable 46 are secured to second cradle beam 26 in an analogous manner. Cable 42 extends from winder segment 56 and exits housing 49. That cable vertically enters beam 17 and is redirected horizontally by a directional pulley 110. A second directional pulley 112 within beam 17 drops cable 42 vertically. The lower end of the cable is fastened to the proximal end of cradle beam 26 by a cable lock 114, FIGS. 1 and 5. This form of attachment is similar to previously described in lock 92.

Second multiple part cable 46 extends from winder segment 60 and likewise exits housing 49 and enters beam 17. Cable 46 is redirected within the beam, first horizontally and longitudinally by pulley 116, FIGS. 4 and 5, and then vertically by pulley 118. The multiple part cable then engages a third directional pulley 120, FIG. 5, mounted in the gap between the C-channels of cradle beam 26. As previously described, cable 46 is directed longitudinally through beam 26 to the distal, outer end of that cradle beam. An associated fourth directional pulley mounted to the distal end of beam 26 (not shown, but see analogous pulley 80 mounted to beam 24 in FIG. 2) directs cable 46 upwardly along piling 20. A fifth directional pulley 122, FIG. 1, for cable 46 redirects that cable downwardly along piling 20, in a manner analogous to that previously described for cable 44. The distal end of cable 46 is then releasably secured by a cable lock 124, FIG. 1, to a distal portion of cradle beam 26. Cables 42 and 46 are extended and retracted in a manner analogous to the manner previously described for cables 40 and 44 so that the proximal and distal ends of cradle beam 26 are raised and lowered as required.

In operation, motor 51 is driven selectively in a first direction to raise the lift and in an opposite, second direction to lower the lift. After a boat is positioned on the lift in a manner shown in the accompanying drawings, it may be raised by operating the motor in the first direction. The motor operates the reduction mechanism to rotate winder drums 54, 56, 58 and 60 so that the respective cables are wound thereon. In particular, cables 40, 42, 44 and 46 are wound onto winder drums 54, 56, 58 and 60, respectively. This pulls and retracts the individual cables. Single part cable 40 is drawn over directional pulleys 70 and 72, so that the proximal end of beam 24 is raised. At the same time, cable 42 is drawn over pulleys 110 and 112 so that the proximal end of beam 26 is raised at the same rate. Likewise, multiple part cables 44 and 46 are retracted over their respective sets of directional pulleys. Cable 44 is drawn over pulleys 74, 76, 78, 80 and 82. Cable 46 is analogously retracted over pulleys 116 and 118, the pulley mounted to the proximal end of beam 26 (obscured), as well as pulleys 120 and 122. By providing the respective winder drums with properly proportioned diameters, the single and multiple part cables are drawn upwardly at identical speeds. The lift platform is thereby raised synchronously, stably, uniformly and evenly. Dangerous tilting is avoided. The lift platform and supported vessel are lowered, when required, by simply reversing operation of the motor to synchronously extend or drop the lift cables. Stable and even movement of the platform is again exhibited.

By employing fixedly interconnected winder drums having correctly proportioned diameters, the present invention eliminates the need to employ unduly complex and expensive reduction means for providing synchronous operation of the proximal and distal cable assemblies. Typically, the multiple part winder drums 58 and 60 have a diameter that is three times the diameter of the single part drums 54 and 56. This provides the multiple part cables 44 and 46 with a speed that is three times the speed imparted to the single part cables. In alternative embodiments the respective winder drums may be mounted for independent rotation relative to one another. In such cases, each drum is operably connected by a respective reduction mechanism to motor 51.

The lift apparatus of this invention uses far fewer components than are required by conventional lifts of this type. As a result the subject lift is fairly simple to assemble and maintain. The cables are driven in a synchronized manner and operate quite reliably so that improved boat lift operation is achieved. The apparatus is extremely cost efficient. It requires the use of only a single motor, which reduces boat lift costs considerably. Additionally, the drive assembly is compact, relatively simple and easy to access. Indeed, the motor and all of the power transmitting structure is located in a housing conveniently mounted centrally on the cable beam. The beam itself is conveniently located proximate the dock, pier or sea wall. In alternative embodiments, the single motor drive may be mounted directly to one or more pilings or other types of support structure.

Various other embodiments may be employed within the scope of this invention. In each version, the lift platform and cable interconnections to the platform may be constructed in the manner to that previously described or in some other similar fashion that should be known to those skilled in the art. It should also be understood that the invention is not limited to a single part and three part cable as shown herein. Various other combinations of single and multiple part cables may be employed within the scope of this invention.

In certain embodiments of this invention, the drive motor may be mounted proximate one end of the cable beam rather than centrally on the beam as shown in FIGS. 1–6. Such versions may employ alternative arrangements of directional pulleys mounted within the cable beam and directing the proximal and distal cables downwardly from the beam. In still other embodiments, the cables may be secured to a carriage that is driven longitudinally within the cable beam. The lift cables may be secured to the carriage and driven extendably and retractably through the beam in response to motor driven operation of the carriage. The carriage itself may be driven longitudinally within the beam by means such as cables that are wound onto and off of respective motor driven winder drums. Alternatively, the carriage may be driven by a screw drive mechanism. The winders or the screw drive are operated in opposing first and second directions by the single motor of this invention. The use of a single motor is a critical feature that is common to each embodiment of the invention. In each embodiment, portions of at least a pair of the cables (i.e. a portion of at least one proximal cable and a portion of at least one distal cable) are driven horizontally and longitudinally through the cable beam before being directed vertically to a respective cradle beam or other side portion of the lift platform.

Each version of this invention achieves a smooth, even and synchronized lifting and lowering operation. A single motor performs the lifting and lowering of all lift cables. A simpler, less expensive, more efficient and nonetheless very effective boat is lift is thereby provided.

Although the versions disclosed herein have each employs four cables, it should be understood that the device may be used in conjunction with other numbers of cables and other combinations of single and multiple part cable lifting systems. In some versions, only a single cable may be mounted on one side and in certain embodiments more than two cables may be used on one or both sides. It is critical that in each embodiment, all of the cables are lifted by a single motor and that a synchronized operation is achieved. In all cases, at least one cable should be mounted to each side of the platform and at least two cables should be attached to at least one of the sides.

In the carriage driven embodiments, the lift cables are raised and lowered by the carriage rather than a relatively small diameter winder as in the past art. This eliminates the constant stress usually exerted on the cables as they are wound and unwound. Cable life is thereby prolonged significantly.

In still other versions of this invention, the lift may be mounted operably on three pilings, with two located on one side and one on the opposite side of the boat. For -example, a cable beam and cable transmission means as described above may be mounted on two pilings on one side of the lift. Alternatively, the motor and cable transmission means may be mounted to a single piling and two pilings may be deployed on the opposite side. In each case, one end of each cradle beam is movably mounted to the single piling and the opposite end of each beam is movably mounted to a respective one of the opposite pair of pilings.

Although specific features of the invention are shown in some drawings and not others, this is for convenience only, as each feature may be combined with any or all of the other features in accordance with the invention.

Other embodiments will occur to those skilled in the art and are within the following claims.

What is claimed:

1. An apparatus for selectively lifting and lowering a boat out of and into a body of water wherein proximal and distal support structures are located on respective sides of the boat, said apparatus comprising:

a single motor mountable on the proximal support structure and being selectively driven in opposing first and second directions;

a boat accommodating platform locatable between the proximal and distal support structures and having proximal and distal sides that are locatable relatively adjacent the proximal and distal support structures, respectively;

proximal cable means including at least a pair of cables operably connected to said proximal side of said platform for enabling raising and lowering thereof;

distal cable means including at least a pair of cables operably connected to said distal side of said platform for enabling raising and lowering thereof, at least one cable in said each of said proximal and distal cable means being operably mountable to the proximal support structure such that operating said motor causes a portion of said cable to be driven generally horizontally and longitudinally relative to the boat; and cable transmission means operably interconnecting each of said cables with said single motor for retracting said cables when said motor is driven in said first direction to synchronously raise said first and second sides of said platform and advancing said cables when said motor is driven in said second direction to synchronously lower said first and second sides of said platform.

2. The apparatus of claim 1 in which said platform includes a pair of interconnected beams for extending transversely beneath the boat, each said beam having a proximal portion and a distal portion.

3. The apparatus of claim 2 in which a respective said cable of said proximal cable means is connected to each said cradle beam at a proximal end portion thereof and wherein a respective said cable of said distal cable means is connected to each said cradle beam at a distal portion thereof.

4. The apparatus of claim 1 in which said cable transmission means includes a winder assembly that is rotatably interconnected to said motor and having a pair of relatively large diameter winder drums operably connected to respective cables of said distal cable means and a second pair of relatively small diameter winder drums operably connected to respective cables of said distal cable means.

5. An apparatus for selectively lifting and lowering a boat out of and into a body of water comprising:

proximal and distal support structures locatable on respective longitudinal sides of the boat;

a single motor mountable on said proximal support structure and being selectively driven in opposing first and second directions;

a boat accommodating platform locatable between said proximal and distal support structures and having proximal and distal sides that are locatable relatively adjacent said proximal and distal support structures, respectively;

proximal cable means including at least a pair of cables operably connected to said proximal side of said platform for enabling raising and lowering thereof;

distal cable means including at least a pair of cables operably connected to said distal side of said platform for enabling raising and lowering thereof, at least one cable in said each of said proximal and distal cable means being operably mountable to the proximal support structure such that operating said motor causes a portion of said cable to be driven generally horizontally and longitudinally relative to the boat; and cable transmission means operably interconnecting each of said cables with said single motor for retracting said cables when said motor is driven in said first direction to synchronously raise said first and second sides of said platform and advancing said cables when said motor is driven in said second direction to synchronously lower said first and second sides of said platform.

6. The apparatus of claim 5 in which said proximal support structure includes a pair of longitudinally spaced apart support members having upper ends that are located above the water.

7. The apparatus of claim 6 in which said support structure further includes a cable beam that is connected to and extends between said first and second support members generally longitudinally beside the boat.

8. The apparatus of claim 7 further including means for operably mounting said cables in said proximal and distal cable means such that at least one cable of said proximal cable means and at least one cable of said distal cable means are driveable through said beam generally longitudinally and horizontally relative to the boat.

9. The apparatus of claim 8 further including means for redirecting each generally longitudinally and horizontally driveable cable within said beam vertically downwardly from said beam such that a distal end portion of said redirected cable is attachable to said lift platform.

10. The apparatus of claim 6 in which said distal support structure includes a pair of longitudinally spaced apart support members that are generally opposed to said first and second support members of said proximal support.

11. The apparatus of claim 4 in which said winder drums are mounted to said proximal support structure for coaxial rotation.

12. The apparatus of claim 11 in which said drums are fixedly interconnected for rotating in unison about a common axis of rotation.

* * * * *